US007396991B2

(12) United States Patent
Susami

(10) Patent No.: US 7,396,991 B2
(45) Date of Patent: Jul. 8, 2008

(54) ELECTRONIC PERCUSSION INSTRUMENT, SYSTEM AND METHOD WITH RIM SHOT DETECTION

(75) Inventor: Ryo Susami, Inasa-gun Hosoe-cho (JP)

(73) Assignee: Roland Corporation, Hamamatsu (JP)

( * ) Notice: Subject to any disclaimer, the term of this patent is extended or adjusted under 35 U.S.C. 154(b) by 561 days.

(21) Appl. No.: 11/030,033

(22) Filed: Jan. 6, 2005

(65) Prior Publication Data

US 2005/0150366 A1 Jul. 14, 2005

(30) Foreign Application Priority Data

Jan. 8, 2004 (JP) ..... 2004-002787

(51) Int. Cl.
*G10H 1/00* (2006.01)

(52) U.S. Cl. ..... 84/615; 84/653; 84/628; 84/656

(58) Field of Classification Search ..... 84/615, 84/653, 628, 656
See application file for complete search history.

(56) References Cited

U.S. PATENT DOCUMENTS 6,031,176 A * 2/2000 Tanaka ..... 84/735

FOREIGN PATENT DOCUMENTS

JP 10-198375 7/1998
JP 2003-108120 4/2003

* cited by examiner

*Primary Examiner*—Lincoln Donovan
*Assistant Examiner*—David S. Warren
(74) *Attorney, Agent, or Firm*—Foley & Lardner LLP

(57) ABSTRACT

An electronic percussion instrument includes input means, comparison means, and musical tone generation control means. The input means allows for the input of a vibration of a head section and a vibration of a rim section that have been detected by a striking detection section. The comparison means allows for a comparison of a size of the vibration of the head section and a size of the vibration of the rim section. The musical tone generation control means allows for controlling a generation of a musical tone based on a result of a comparison by the comparison means such that the musical tone corresponds either to the vibration of the head section or to the vibration of the rim section. In those cases where the musical tone corresponds to the vibration of the rim section, the generation of the musical tone can be further controlled.

21 Claims, 8 Drawing Sheets

ELECTRONIC PERCUSSION INSTRUMENT, SYSTEM AND METHOD WITH RIM SHOT DETECTION

CROSS-REFERENCE TO RELATED PATENT APPLICATIONS

Japan Priority Application 2004-002787, filed Jan. 08, 2004 including the specification, drawings, claims, and abstract, is incorporated herein by reference in its entirety.

BACKGROUND OF THE INVENTION

1. Field of the Invention

Embodiments of the present invention relate to an electronic percussion instrument and, in particular embodiments, to an electronic percussion instrument with which a musical tone is generated in conformance with output of sensors that are respectively disposed on a head and a rim.

2. Related Art

In a performance with an acoustic drum, in addition to the usual performance in which only the striking surface (the head) is struck, it is possible to broaden the scope of the performance by the so-called rim shot performance method. For the rim shot, there are, in general, two types of performance methods: (i) the open rim shot in which the rim and the striking surface (the head) are struck at the same time and a hard striking sound effect that includes many characteristic drum overtones is produced; and (ii) the closed rim shot in which only the rim is struck and a "clattering" percussive sound is produced.

For some time, electronic percussion instruments have been disclosed where the type of performance method that has been performed (an open rim shot or a closed rim shot) is detected in the electronic percussion instrument and musical tones are generated that correspond to the respective performance methods.

In Japanese Laid-Open Patent Application Publication (Kokai) Number 2003-108120 (Patent Reference 1), an electronic percussion instrument is disclosed in which two switches SW1 and SW2 are disposed on the rim section of the electronic percussion instrument. In such an electronic percussion instrument, a sound is generated that switches between a musical tone that corresponds to an open rim shot and a musical tone that corresponds to a closed rim shot in conformance with the conduction state of the two switches.

In addition, in Japanese Laid-Open Patent Application Publication (Kokai) Number Hei 10-198375 (Patent Reference 2), an electronic percussion instrument is disclosed in which a head sensor and a rim shot sensor are arranged on a support member that is placed inside a hollow body of the electronic percussion instrument. The head sensor is affixed on a top surface of the hollow body and detects the vibration of the head. The rim shot sensor detects the vibration of the rim section. Using the rim shot sensor, it is possible to uniformly detect a striking force without depending on which location of the rim section has been struck.

However, with the invention that has been disclosed in Patent Reference 1, two switches must be disposed on the rim section of the electronic percussion instrument. Thus, there is the problem that the cost of the electronic percussion instrument becomes high. Also, there are the problems that the performer must carry out the performance by differentiating between the two switches and the performance methods are constrained.

In Patent Reference 2, a mechanism is disclosed in which the striking forces that have been imparted to the head section and the rim section are respectively detected. However, there is no disclosure in Patent Reference 2 as to the generation of a variety of musical tones that conform to performance methods, such as an open rim shot or a closed rim shot, in accordance with the striking force that has been detected.

SUMMARY OF THE INVENTION

Embodiments of the present invention address problems as described above and relate to an electronic percussion instrument, system, and process with which it is possible to detect a performance method with a simple structure and to generate a musical tone that is appropriate for the performance method that has been detected.

An electronic percussion instrument in accordance with a first embodiment is furnished with input means with which the vibration of a head section and the vibration of a rim section that have been detected by a striking detection section are input, and comparison means in which the size of the vibration of the head section and the size of the vibration of the rim section that have been input in the input means are compared, and musical tone generation control means in which control based on the results of the comparison by the comparison means is done such that either a musical tone that corresponds to the vibration of the head section or that corresponds to the vibration of the rim section is generated, and in those cases where a musical tone that corresponds to the vibration of the rim section is generated, control based on the ratio of the size of the vibration of the head section and the size of the vibration of the rim section is done such that either a first musical tone or a second musical tone is generated.

An electronic percussion instrument in accordance with a second embodiment is furnished with input means with which the vibration of a head section and the vibration of a rim section that have been detected by a striking detection section are input, and comparison means in which the size of the vibration of the head section and the size of the vibration of the rim section that have been input in the input means are compared, and leading edge polarity detection means in which the detection of the leading edge of the vibration of the head section that has been input in the input means is detected, and is furnished with musical tone generation control means in which control based on the results of the comparison by the comparison means is done such that either a musical tone that corresponds to the vibration of the head section or that corresponds to the vibration of the rim section is generated, and in those cases where a musical tone that corresponds to the rim section is generated, control is done such that either a first musical tone or a second musical tone is generated in conformance with the polarity of the leading edge of the vibration of the head section that has been detected by the leading edge polarity detection means.

An electronic percussion instrument in accordance with a third embodiment is, for an electronic percussion instrument in accordance with a first or second embodiment, one in which the musical tone generation control means is one in which in those cases where a first musical tone or a second musical tone is generated in conformance with the vibration of the rim section, the mixing proportion of the two musical tones is controlled based on the ratio of the size of the vibration of the head section and the size of the vibration of the rim section.

An electronic percussion instrument in accordance with a fourth embodiment is, for an electronic percussion instrument in accordance with a first, second, or third embodiment, furnished with a head section that is disposed stretched on the top surface of a hollow body section, and a rim section for applying tension to the head, and a support member that is linked to the inside of the body section and that transmits the vibrations of the rim section, and a head sensor that is arranged on the support member with the interposition of a vibration absorbing member and which detects the vibration of the head section, and a rim shot sensor that detects the vibration of the rim section by means of the detection of the vibration of the support member.

In accordance with an electronic percussion instrument of the first embodiment, since the instrument is furnished with musical tone generation control means in which in those cases where a musical tone is generated that corresponds to the vibration of the rim section, control is done such that either a first musical tone or a second musical tone is generated based on the ratio of the size of the vibration of the head section and the size of the vibration of the rim section, it is possible to reliably detect which of the performance methods from among the open rim shot method and the closed rim shot method has been performed. Also, there is the advantageous result that a musical tone can be generated that is in accord with the performance method that has been detected. In addition, since it is possible to employ a sensor for carrying out the detection, which is a sensor that has been used in the past, there is the advantageous result that which performance method has been performed can be detected with a simple and inexpensive circuit configuration.

In accordance with an electronic percussion instrument of the second embodiment, since the instrument is furnished with leading edge polarity detection means with which the polarity of the leading edge of the vibration of the head section that has been input in the input means is detected and is furnished with musical tone generation control means in which in those cases where a musical tone that corresponds to the rim section is generated, control is done such that either a first musical tone or a second musical tone is generated in conformance with the polarity of the leading edge of the vibration of the head section that has been detected by the leading edge polarity detection means, it is possible to reliably detect which of the performance methods from among the open rim shot method and the closed rim shot method has been performed. Also, there is the advantageous result that a musical tone can be generated that is in accord with the performance method that has been detected. In addition, since it is possible to employ a sensor for carrying out the detection, which is a sensor that has been used in the past, there is the advantageous result that which performance method has been performed can be detected with a simple and inexpensive circuit configuration.

In accordance with an electronic percussion instrument of the third embodiment, in addition to the advantageous result that are exhibited by electronic percussion instruments of the first and second embodiments, since in those cases where a first musical tone or a second musical tone is generated that corresponds to the vibration of the rim section, the mixing proportion of the two musical tones is controlled based on the ratio of the size of the vibration of the head section and the size of the vibration of the rim section, there is the advantageous result that musical tones can be generated having variegated timbres in accordance with the performance method at the time that the performance of the rim shot is carried out.

In accordance with an electronic percussion instrument of the fourth embodiment, in addition to the advantageous results that are exhibited by the electronic percussion instruments of the first, second, and third embodiments, since the instrument is furnished with a head section that is disposed stretched on the top surface of a hollow body section, and a rim section for applying tension to the head, and a support member that is linked to the inside of the body section and that transmits the vibrations of the rim section, and a head sensor that is arranged on the support member with the interposition of a vibration absorbing member and which detects the vibration of the head section, and a rim shot sensor that detects the vibration of the rim section by means of the detection of the vibration of the support member, there is the advantageous result that it is possible to faithfully detect the vibration of the head section and the vibration of the rim section that correspond to a performance method such as the case in which only the head section is struck, when there is an open rim shot, or when there is a closed rim shot.

BRIEF DESCRIPTION OF THE DRAWINGS

FIG. 3(*b*) is a top surface drawing of the head sensor of FIG. 3(*a*), and FIG. 3(*c*) is a bottom surface drawing of the head sensor of FIG. 3(*a*);

DETAILED DESCRIPTION OF PREFERRED EMBODIMENTS

Figure 1:
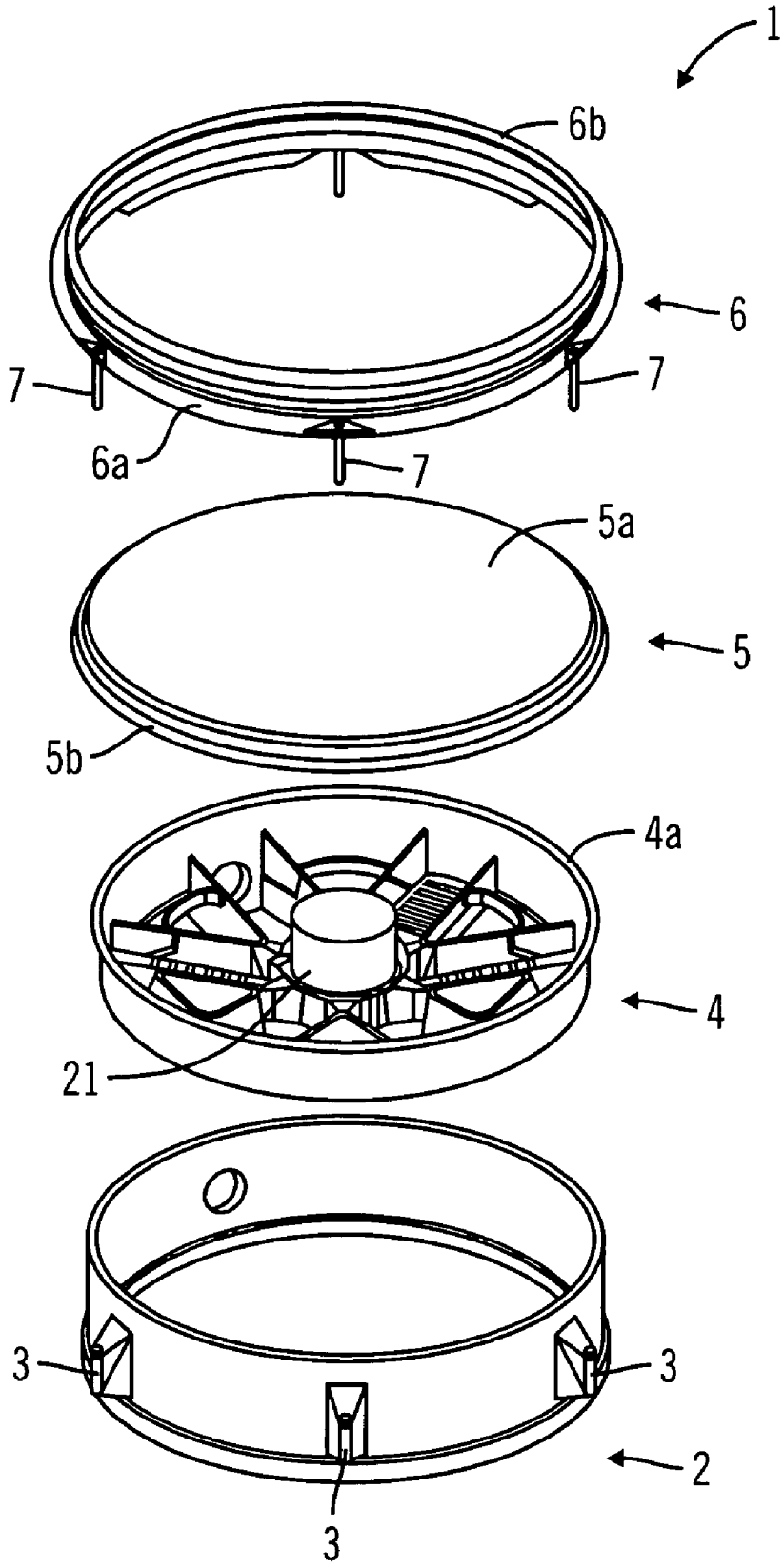
FIG. 1 is a disassembled oblique view drawing of a striking detection section of an electronic percussion instrument in accordance with an embodiment of the invention.
Figure 2:
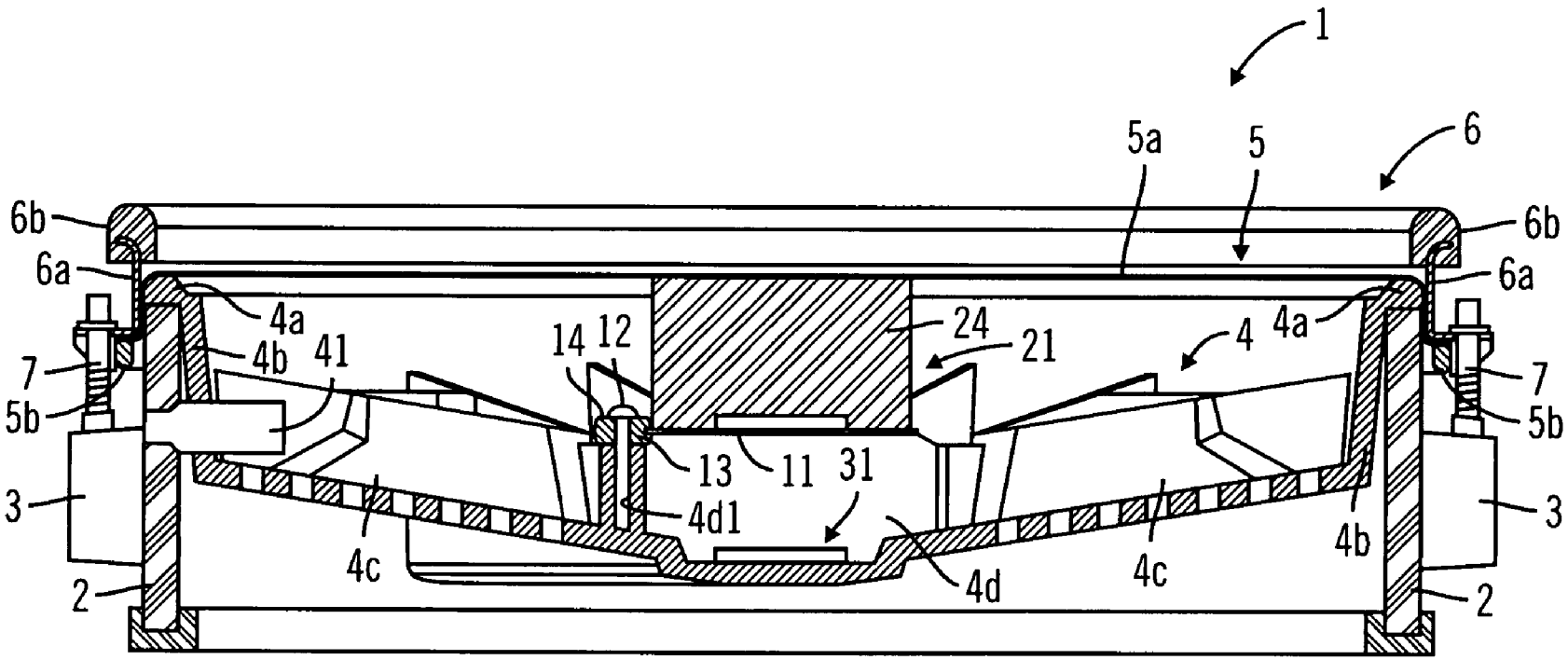
FIG. 2 is a cross-section drawing of a striking detection section.
Figure 3A:
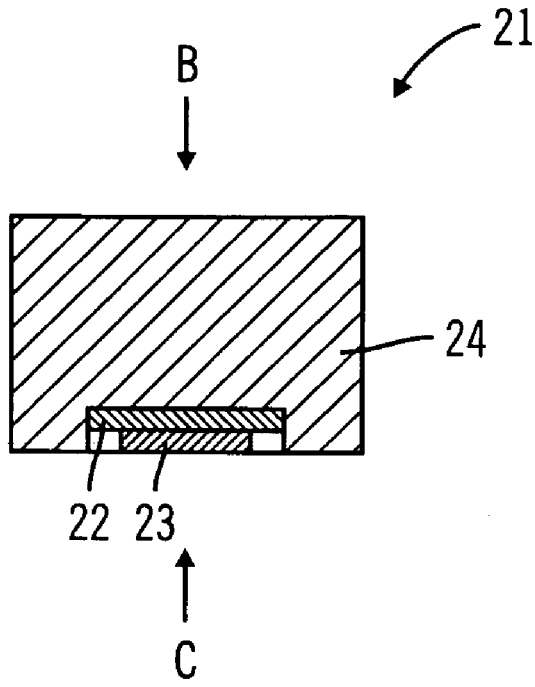
FIG. 3(*a*) is a lateral surface drawing of a head sensor.
Figure 3B:
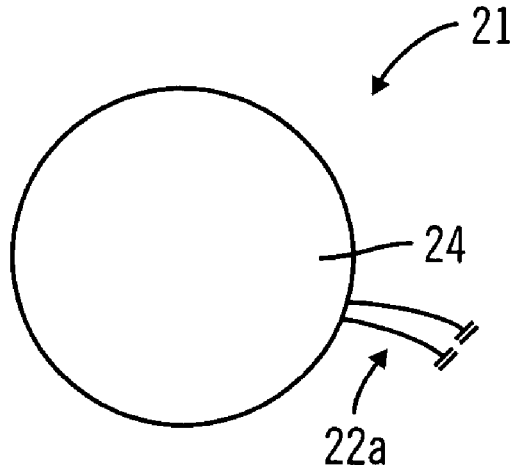
Figure 3C:
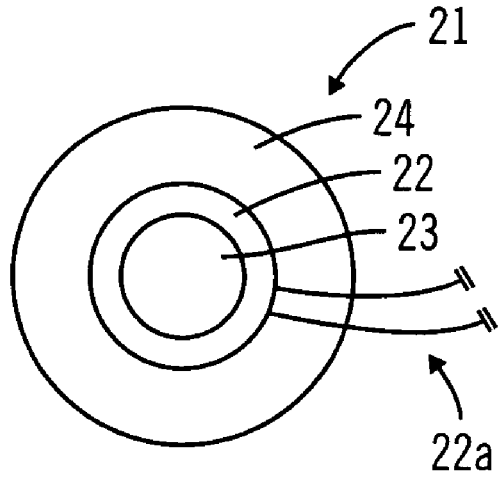

Explanations will be given below regarding embodiments of the present invention while referring to the attached drawings. First, an explanation will be given regarding a striking detection section 1 of an electronic percussion instrument in accordance with an embodiment of the invention, while referring to FIGS. 1-3. FIG. 1 is a disassembled oblique view drawing of the striking detection section 1. FIG. 2 is a cross-section drawing of a case in which the striking detection section 1, which is in an assembled state, has been cut on a vertical surface that passes through the center of the striking detection section 1. FIG. 3 is a drawing that shows a configuration of a head sensor in detail.

An electronic percussion instrument of an embodiment, known as a so-called "electronic drum" or "electronic pad" that employs a stick and the like for striking, comprises the striking detection section 1. The striking detection section 1 is furnished with a sensor with which the vibration due to a striking is detected. A musical tone generation system (which will be discussed later), controls a sound source based on a detection signal of the sensor with which the striking detection section 1 has been furnished. The musical tone generation system is configured such that a musical tone is generated that conforms to the striking. The musical tone that has been generated is emitted from a speaker system via an amplifier system.

The striking detection section 1 is also furnished with the rim shot sensor 31 that detects the striking of the rim 6 and the head sensor 21 that detects the striking of the head 5. The striking detection section 1 is configured so that it is possible to reproduce a performance method that employs a so-called "rim shot".

The striking detection section 1 is, as is shown in FIG. 1, primarily furnished with the body section 2, the sensor frame 4, the head 5, and the rim 6. The striking detection section 1 is configured so that it is possible to be assembled by superposing each of these members in order and screwing and fixing the body section 2 to the rim 6.

The body section 2 is a member that makes up the framework of the striking detection section 1 and, as is shown in FIG. 1, is formed in a roughly hollow cylindrical shape from, for example, a wooden material or a resin material. The sensor frame 4 is housed in the inner peripheral section of the body section 2. The head 5 and the rim 6 are disposed covering the top end (the top in FIG. 1) of the body section 2. In addition, a plurality (six in this preferred embodiment) of latching sections 3 are arranged on the outer peripheral section of the body section 2 protruding in the direction of the diameter.

The male threaded latching bolts 7 of the rim 6 and the female threads that can be screwed together are threaded on the inside of the latching section 3. The rim 6 is screwed and fixed to the body section 2 by screwing in the latching bolts 7 to the relevant latching section 3.

The sensor frame 4 is a container form body having a roughly circular shape viewed from the front that is open on the top surface (the top in FIG. 1). The head sensor 21 and the rim shot sensor 31 are arranged in the center of the sensor frame 4 (refer to FIG. 2).

The head 5 is a component that is configured as a striking surface that is struck with a stick and the like and is constructed with the striking member 5*a* and the frame 5*b*. The striking member 5*a* comprises a reticular material woven from synthetic fiber and a film form material that is formed from a synthetic resin. The striking member 5*a* is adhered to the frame 5*b*. The frame 5*b* comprises a metal material and the like and is ring shaped as viewed from the front (refer to FIG. 2).

In the assembled state of the striking detection section 1, the head sensor 21 is arranged such that the sensor is in contact with the head 5 (the striking member 5*a*; refer to FIG. 2) and the vibration of the striking member 5*a* due to the striking is detected by the head sensor 21.

The rim 6 is fixed to the body section 2 holding the sensor frame 4 and the head 5 between the rim and the body. The rim 6 is a member that has a role of surrounding the outer periphery of the head 5 and applying tension to the head 5. As is shown in FIG. 1, the rim 6 is configured with a plurality (in this preferred embodiment it is six) latching bolts 7, which are attached so that they are free to rotate, to the metal rim fitting 6*a*. The metal rim fitting 6*a* comprises a metal material and the like that is formed in roughly a ring shape viewed from the front.

The latching bolts 7 are items for screwing and joining the rim 6 to the body section 2 and are arranged at roughly equal intervals in the circumferential direction of the metal rim fitting 6*a* corresponding to the latching sections 3 that are disposed on the body section 2. When the relevant latching bolt 7 is screwed into the latching section 3, the rim 6 is screwed and joined to the body section 2 as discussed above. Also, since the rim 6 and the sensor frame 4 are linked with the interposition of the head 5, a transmission path is formed for the vibration at the time of a rim shot to the rim shot sensor 31 (refer to FIG. 2). The upper peripheral edge of the metal rim fitting 6*a* is covered with a cover member 6*b* that comprises an elastic material such as rubber and the like. The configuration is such that the sound of the striking of the rim that is directly heard by the performance at the time of a rim shot is reduced due to the buffering action of the relevant cover member 6*b*.

In the case where the striking detection section 1 is assembled, first, as is shown in FIG. 1, the sensor frame 4 is inserted into the body section 2 from the top end (the top in FIG. 1), and the flange section 4*a* is mated to the upper peripheral edge of the body section 2. Then, the head 5 and the rim 6 are placed in that order on the top (the top in FIG. 1) of the sensor frame 4, and the latching bolts 7 of the rim 6 are screwed into the latching section 3 of the body section 2.

Since the flange section 4*a* of the sensor frame 4 is held between the body section 2 and the rim 6 with the interposition of the head 5, and is firmly fixed without chattering, there is no need to use attachment screws and the like to fix the relevant sensor frame 4 into the body section 2. As a result, it is possible to assemble the striking detection section 1 by means of extremely simple work.

Next, an explanation will be given regarding an assembly and attachment of the sensor frame 4 to the striking detection section 1 as well as an attachment of the head sensor 21 and the rim shot sensor 31 to the sensor frame 4 while referring to FIG. 2. FIG. 2 is a cross-section drawing that has been cut on the vertical surface that passes through the center of the striking detection section 1. It should be noted that, in FIG. 2, the drawing is shown with the connecting wiring that electrically connects the output signal jack 41 and the head sensor 21 and the like omitted.

With regard to the head 5, the striking member 5*a* is spread and stretched on the top edge surface (the top in FIG. 2) of the body section 2 by the frame 5*b*. The striking member 5*a* is the striking surface. The frame 5*b* is fit to the outer periphery of the body section 2. The head sensor 21 is in contact with the lower surface (the bottom surface in FIG. 2) of the striking member 5*a* that has been spread and stretched.

Because the vibration of the striking member 5*a* due to the striking is propagated only within the striking member 5*a*, the body section 2 is not affected very much by the vibration. Accordingly, the vibration of the relevant striking member 5*a* is detected only by the head sensor 21, and there is no erroneous detection by the rim shot sensor (which will be discussed later).

The rim 6, as discussed above, is furnished with the metal rim fitting 6*a* that is formed in roughly a ring shape viewed from the front. A plurality of latching bolts 7 are attached to the metal rim fitting 6*a* so that they are free to rotate. The cover member 6*b* is disposed covering the rim fitting 6*a*. As is shown in FIG. 2, the rim 6 is mounted on the upper edge surface (the top in FIG. 2) side of the body section 2 by screwing and joining the latching bolts 7 into the latching sections 3.

Since the striking member 5*a* of the head 5 is restricted from shifting downward by the flange section 4*a* of the sensor frame 4, the striking member 5*a* is spread and stretched at a specified tensile force. As a result, the striking surface is formed on the upper end surface of the body section 2 by the relevant striking member 5*a*. In addition, since the sensor frame 4 is pressed toward the upper peripheral edge (the top in FIG. 2) of the body section 2 by the tensile force of the striking member 5*a*, the frame is firmly fixed without chattering in the relevant body section 2.

It is possible to adjust the tensile force of the striking member 5*a* as desired in conformance with the preference of the performer and the performance method by a suitable modification of the amount that the latching bolts 7 are screwed into the latching sections 3.

The sensor frame 4 is configured by the flange section 4*a*, the outer wall section 4*b*, the linking section 4*c*, and the core section 4*d*. The flange section 4*a* is configured such that the flange is roughly uniformly in contact with the upper peripheral edge of the body section 2 across the entire periphery. The outer wall section 4*b* is a component that is disposed extending toward the bottom from the flange section 4*a*. The linking section 4*c* is a component that links the inner peripheral surface of the outer wall section 4*b* and the core section 4*d*. The head sensor 21 and the rim shot sensor 31 are each attached to the core section 4*d*. The head sensor 21 is arranged on the support plate 11, and the support plate 11 is screwed and attached to the core section 4*d* by the attachment screw 12 with the interposition of the vibration isolation damper 13. Therefore, the vibration due to a rim shot that is propagated in the sensor frame 4 is absorbed by the vibration isolation damper 13. Since the propagation of the vibration to the support plate 11 is limited, the erroneous detection of vibration due to a rim shot by the head sensor 21 is prevented.

A damper fixing member 14 comprising metal or resin and having a specified height with a shape roughly like that of a short post centered on a low pedestal when viewed in a cross-section is inserted interposed between the attachment screw 12 and the vibration isolation damper 13. The damper fixing member 14 is configured so as to prevent excessive compression of the vibration isolation damper 13.

An explanation will be given regarding the head sensor 21 while referring to FIG. 3.

FIG. 3(*a*) is a lateral surface drawing of the head sensor 21. FIG. 3(*b*) is a top surface drawing of the head sensor 21 viewed from the direction of the arrow B in FIG. 3(*a*). FIG. 3(*c*) is a bottom surface drawing of the head sensor 21 viewed from the direction of the arrow C in FIG. 3(*a*). In FIGS. 3(*a*) through (*c*), the output signal line 22*a* of the piezoelectric element 22 has been shown in the drawing partially omitted.

The head sensor 21 is, as discussed above, a sensor device for the detection of the vibration of the head 5. The head sensor 21 is furnished with the piezoelectric element 22 and the double sided tape 23 having cushioning properties, as is shown in FIG. 3(*a*). Also, the head sensor 21 is configured with the piezoelectric element 22 disposed covered by the cushion member 24. The piezoelectric element 22 may comprise a piezoelectric vibration detection sensor and the like that converts vibration into an electrical signal. As is shown in FIGS. 3(*b*) and (*c*), the piezoelectric element 22 may be formed as a roughly disk shaped body that is furnished with the output signal line 22*a*. In addition, the cushion member 24, which will be discussed later, and the double sided tape 23 having cushioning properties are respectively affixed to the top and bottom surfaces (the top and bottom surfaces in FIG. 3(*b*)) of the piezoelectric element 22.

The output signal line 22*a* is connected to the output signal jack 41 (refer to FIG. 2), and the electrical signal from the piezoelectric element 22 is output via the output signal jack 41.

The double sided tape 23 having cushioning properties is a member for affixing the piezoelectric element 22 to the support plate 11 (refer to FIG. 2) and is configured as so-called double sided tape that has adhesive layers which are laminated to the upper and lower surfaces of a cushion layer. The double sided tape 23 having cushioning properties is, as is shown in FIGS. 3(*a*) and (*c*), formed as roughly a disk shaped body, and the piezoelectric element 22 is affixed to the support plate 11 by the double sided tape 23 having cushioning properties.

The cushion member 24 is a member for the transmission of the vibration from the head 5 to the piezoelectric element 22 and, as is shown in FIGS. 3(*a*) through (*c*), is formed in a roughly cylindrical shape from an elastic member such as sponge and the like. The cushion member is configured to house the piezoelectric element 22 in the concave hollow area that is disposed on its bottom.

The cushion member 24 is formed as a cylindrical shaped body having a diameter that is larger than that of the piezoelectric element 22. The configuration is such that the upper surface (the top in FIG. 3(*b*)) of the cylindrical shaped body is in contact with the bottom surface of the head 5 (the striking member 5*a*; refer to FIG. 2). Therefore, since the cushion member 24 of this preferred embodiment maintains a wider contact region with the head 5 compared to a cushion member of the past that had a trapezoidal shape viewed from the side, in other words, a cushion member having a shape in which the end becomes narrower as the end gets closer to the head, the variations in the striking sensitivity of the head sensor 21 are made small, and it is possible to design for improved performance qualities.

The rim shot sensor 31 is a piezoelectric element like that used for the head sensor 21 and is affixed to the sensor frame 4 using double sided tape having cushioning properties.

Figure 4:
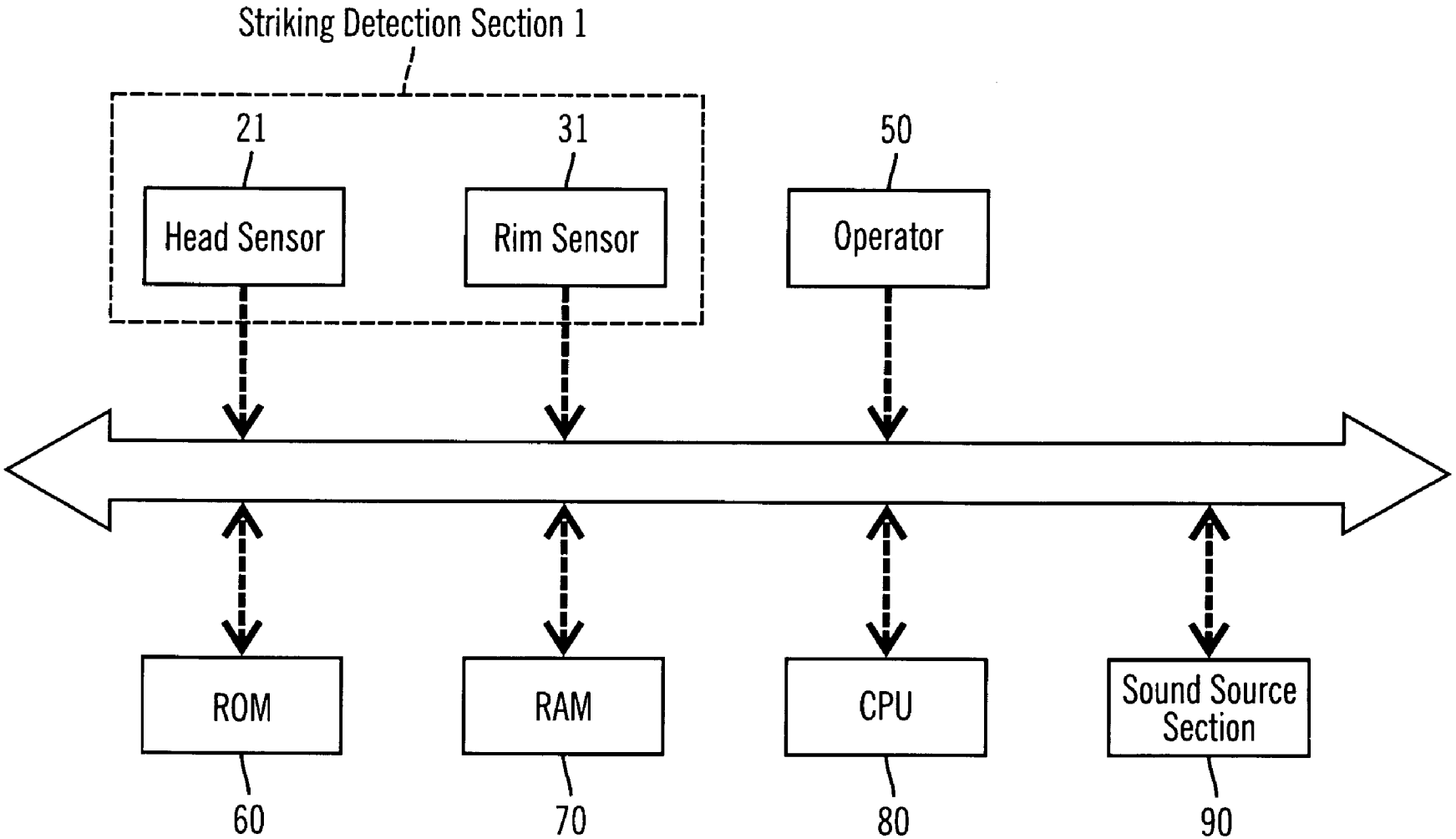
FIG. 4 is an electrical block diagram of an electronic percussion instrument in accordance with an embodiment of the invention.

Next, an explanation will be given regarding a musical tone generation system of an electronic percussion instrument of an embodiment. FIG. 4 is a block diagram that shows an electrical configuration of an electronic percussion instrument of an embodiment. A musical tone generation system is configured with an input section to which the output signals of the head sensor 21 and the rim shot sensor 31 with which the striking detection section 1 discussed above has been furnished are input, an operator 50, a ROM 60, a RAM 70, a CPU 80, and a sound source section 90, and these are connected though a bus.

The output signals of the head sensor 21 and the rim shot sensor 31 with which the striking detection section 1 has been furnished are input to the musical tone generation system through the plug and the connection cord that have been connected to the output signal jack. These output signals, which are analog signals, are converted into digital signals at specified time intervals by an A/D converter (not shown in the drawing), and the converted values are stored in the RAM 70 of the musical tone generation system.

The operator 50 is a type of knob or a switch for setting each of the various parameters of the musical tone generation system. The operator 50 may be used to set the volume and timbre of the musical tone that is generated by the musical tone generation system as well as the effects that are applied to the musical tone and the like.

The ROM 60 stores the programs that are executed by the CPU 80, as well as each of the various fixed values and the like. The RAM 70 stores the values of the sensors that have been A/D converted as discussed above and functions as a working RAM in which variables and the like are stored temporarily when each of the various processes is carried out by the CPU 80.

The CPU 80 is a central processing unit that carries out a control of the musical tone generation system and carries out the various types of processing by executing the programs that have been stored in the ROM 60.

The sound source section 90 is controlled by the CPU 80. The sound source section 90 forms the musical tones and stores the waveforms for each of the various drum sounds. The sound source 90 reads out the waveforms, adds an envelope, modifies the pitch, applies an effect, and produces an output. Sounds such as that of a snare drum, an open rim shot for a snare drum, a closed rim shot for a snare drum, and the like are obtained with a microphone as the various types of drum sounds, digitized, and stored. With regard to the open rim shot, the sound in those cases where the center area of the head and the rim have been struck at the same time (hereinafter, referred to as an "inside open rim shot sound") and the sound in those cases where the portion of the head near the rim and tile rim have been struck at the same time (hereinafter, referred to as an "outside open rim shot sound") are stored. With these waveforms, the waveform that is read out in those cases where a striking has been detected by the striking detection section 1 can be set as desired.

Figure 5A:
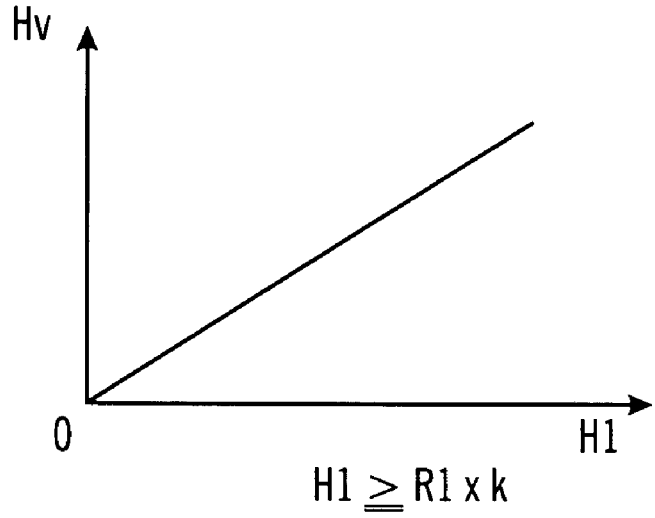
FIG. 5(*a*) is a graph that shows a relationship between a vibration level and a velocity, FIG. 5(*b*) is another graph that shows a relationship between a vibration level and a velocity, and FIG. 5(*c*) shows a graph of a relationship between a mixing ratio and a control change.
Figure 5B:
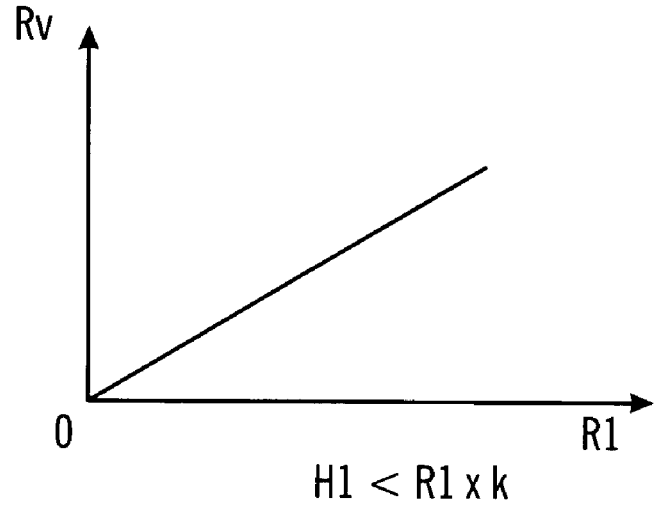
Figure 5C:
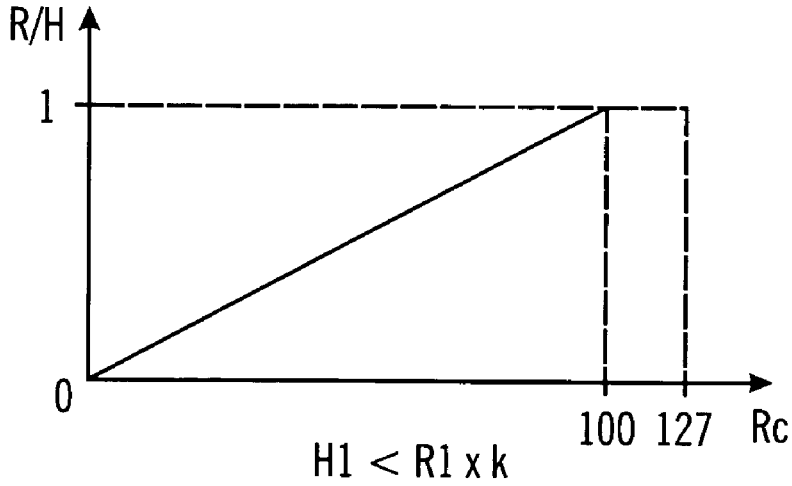
Figure 6:
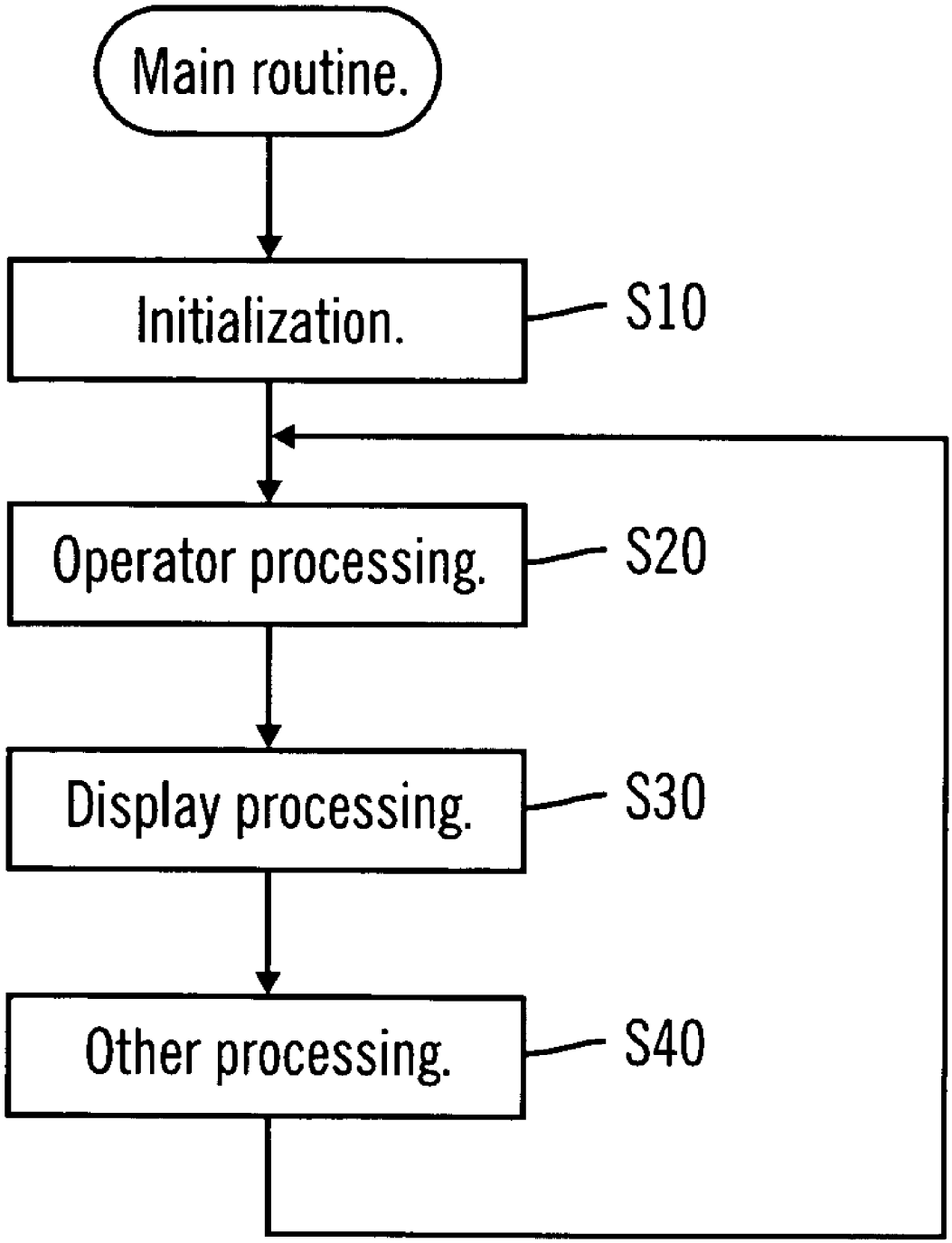
FIG. 6 is a flowchart that represents a main routine.
Figure 7A:
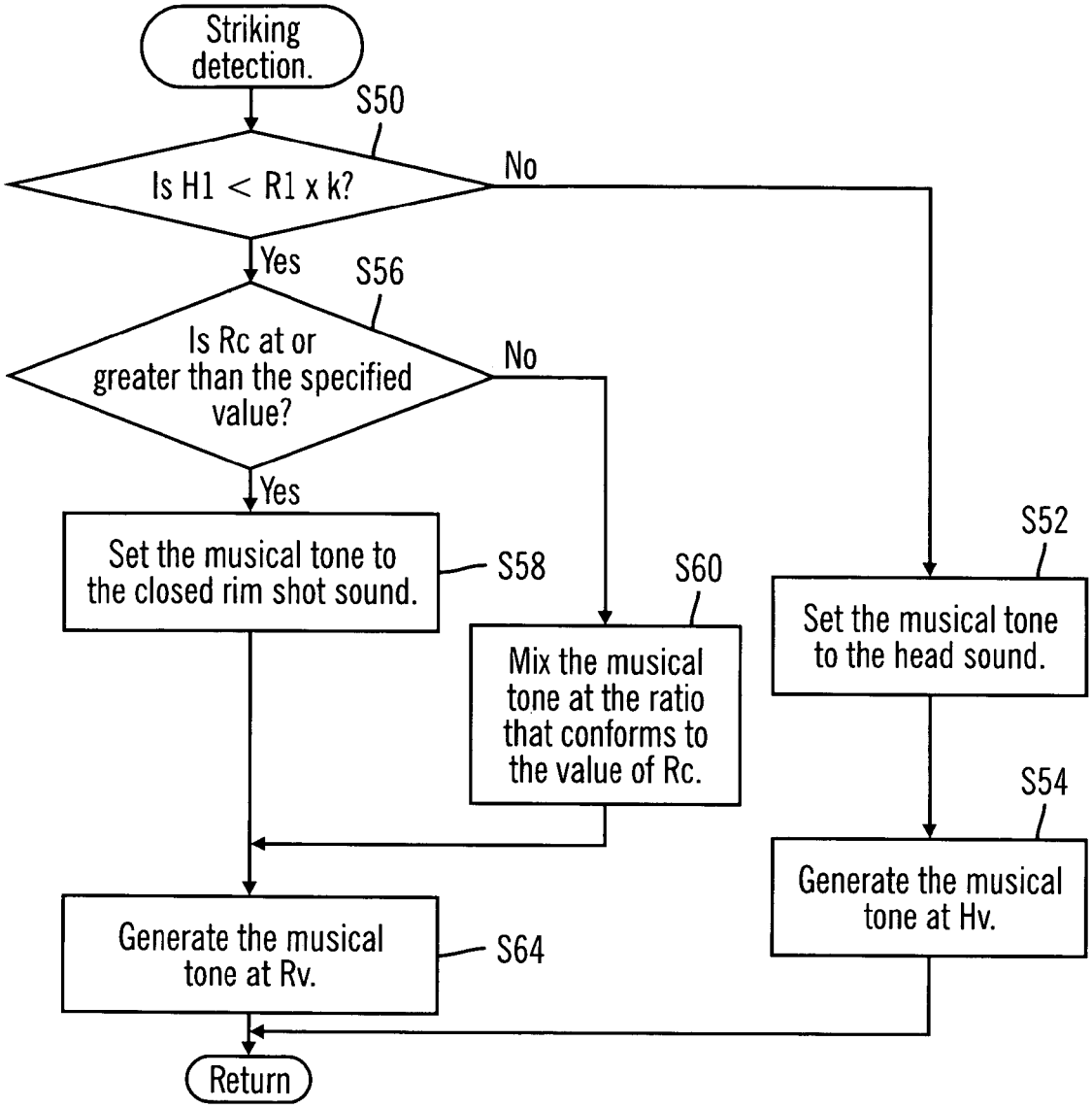
FIG. 7(*a*) is a drawing that represents an interrupt routine that is launched when vibrations of a head sensor and a rim shot sensor have been detected, and FIG. 7(*b*) is a drawing that represents additional processing that can be inserted into the interrupt routine of FIG. 7(*a*)
Figure 7B:
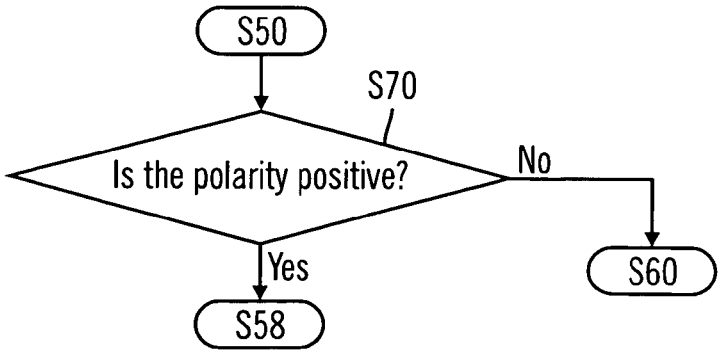
Figure 8A:
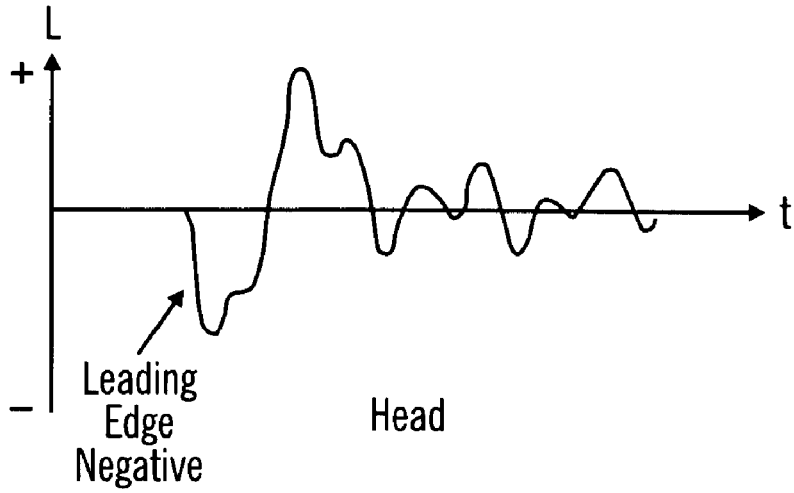
FIG. 8 is a drawing that shows, for three cases, waveforms of vibrations that have been output by a head sensor, FIG. 8(*a*) shows a waveform for vibrations when only a head is struck, FIG. 8(*b*) shows a waveform for vibrations of an open rim shot, and FIG. 8(*c*) shows a waveform for vibrations of a closed rim shot.
Figure 8B:
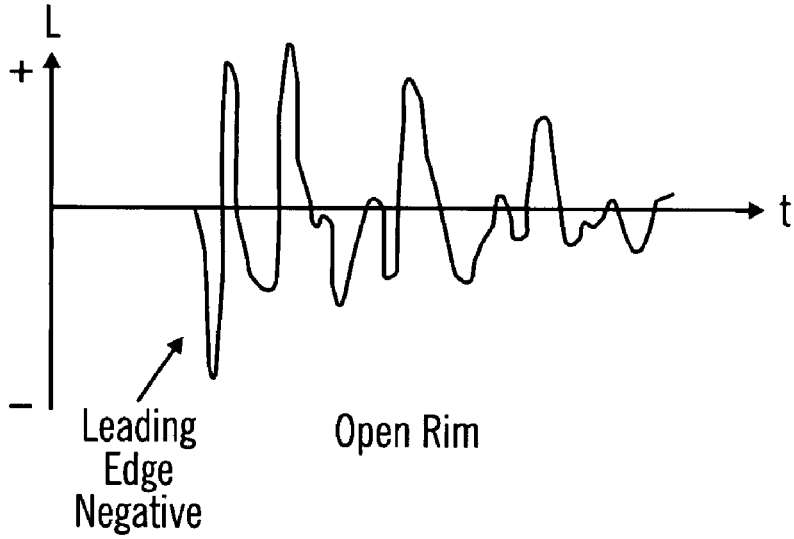
Figure 8C:
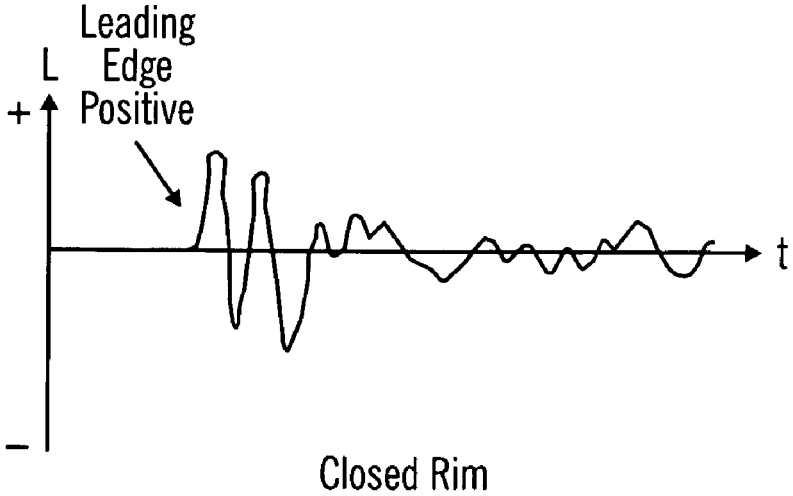

Next, an explanation will be given regarding musical tone generation processing of an embodiment of the present invention that is carried out by the CPU 80 while referring to the graphs that are shown in FIG. 5, the flowcharts that are shown in FIG. 6 and FIG. 7, and the vibration waveform drawings that are shown in FIG. 8.

With regard to the output signals of the head sensor 21 and the rim shot sensor 31, the amplitudes are at maximum value immediately after striking, and decay after that. The maximum value of the amplitude of the vibration for the head sensor 21 is made H1 and the maximum value of the vibration for rim shot sensor 31 is made R1.

FIG. 6 is a flowchart that represents a main routine that is carried out from when the power for a musical tone generation system is turned on until the power is turned off. First, when the power is turned on, initialization is carried out (S10). For the initialization, each of the various parameters is set, and such processing as that for the settings so that the interrupt routine that is shown in FIG. 7 is launched and the like, is carried out. Next, the setting state of the operator 50 is detected in those cases where the result of the detection is that the setting state has been changed and the parameters and the like are modified in conformance with the setting (S20). Next, a display is carried out on a display device (not shown in the drawings) that corresponds to the settings of the parameters and the like (S30). For example, in those cases where only the area of the head to which the snare drum sound is assigned has been struck, a snare drum sound is generated, in those cases where an open rim shot has been made, the open rim shot sound of a snare drum is generated, and in those cases where a closed rim shot has been made, the settings are such that the rim shot sound of a snare drum is generated, and the titles of the musical tones that correspond to the respective performance methods and that have been set are displayed.

Next, other processing is carried out (S40) and the routine returns to the processing of S20. With regard to other processing, this includes processing that corresponds to a MIDI input in those cases where there has been a MIDI input (not shown in the drawings) and the like.

FIG. 7 is an interrupt routine that is launched when the vibration of the head sensor 21 or of the rim shot sensor 31 has been detected. These detections are made H1 and R1, which are the respective maximum values of the vibration of the head sensor 21 and the rim shot sensor 31.

First, a determination is made as to whether or not the maximum value H1 of the amplitude of the vibration of the head is smaller than the value in which the maximum value R1 of the amplitude of the vibration of the rim sensor has been multiplied by a specified coefficient k (S50). The coefficient k is a value that is greater than 1. This is done because the head sensor 21 detects the vibration of the head 5 through the cushion 24 that is in contact with the center area of the head 5, but the rim shot sensor 31 detects the vibration of the rim section 6 from the vibration that is propagated through the sensor frame 4. The amplitude of the latter is small compared to the amplitude that is detected by the head sensor 21 and, thus, by multiplying by a coefficient k, the figure is corrected and the comparison can be performed.

In those cases where the result of the comparison is that the value of H1 is smaller than the value of R1 that has been multiplied by k (S50: yes), the routine advances to the processing of S56. In those cases where the value of H1 is greater than or equal to the value of R1 that has been multiplied by k (S50: no), the sound source section 90 is controlled such that the musical tone that corresponds to the head (S52) is generated at Hv, which is the velocity that corresponds to the value of H1 (S54), and processing returns from this routine. With regard to the musical tone that corresponds to the head 5, in those cases where the striking detection section 1 is a snare drum, a sound in which only the head of a snare drum has been struck is desired. In the case of a tom-tom, a sound in which only the head of a tom-tom has been struck is desired. It may also be set up such that the performer can make any setting desired for the musical tone that corresponds to the head 5.

FIG. 5(*a*) is a graph that displays a relationship between H1 and Hv in those cases where a musical tone that corresponds to the head 5 is generated and a directly proportional relationship is set between H1 and Hv. Depending on the sensitivity of the sensor and the characteristics of the musical tone, the correspondence relationship may be made a relationship that is expressed as a curve and not as a directly proportional one.

For the processing of S56, two embodiment will be described. FIG. 7(*a*) shows processing including a first embodiment of the processing of S56. FIG. 7(*b*) shows a second embodiment with the processing of S70 substituted for the processing of S56 in FIG. 7(*a*). In the first embodiment of the processing of S56, Rc is derived from the values of H1 and R1 described above according to the equation:

$$Rc=G\times(R1\times k-H1)/R1$$

A determination is made as to whether or not the value of Rc is at or above a specified value (S56). Here, G is a specified coefficient and is something for the purpose of making it such that the value of Rc becomes a control change (a value from 0 to 127), which is one of the messages that are stipulated in the MIDI standards.

(R1×k−H1)/R1 expresses the ratio between the size of one type of R1 and the size of H1, and it may also be done simply with R1/H1 multiplied by a specified coefficient.

In those cases where, in the determination processing of S56, the value of Rc is greater than a specified value (S56: yes), the sound source section 90 is controlled such that a closed rim shot sound from among the musical tones that correspond to the rim (S58) is generated at the velocity Rv that corresponds to R1 (S64). A relationship between R1 and Rv is shown in FIG. 5(*b*). The relationship shown between R1 and Rv is also set to be directly proportional, but depending on the sensitivity of the sensor and the characteristics of the musical tone, the relationship may also be made a relationship that is expressed as a curve and not as a directly proportional one.

On the other hand, in those cases where, in the determination processing of S56, the value of Rc is smaller than a specified value (S56: no), the control is done such that an open rim shot sound from among the musical tones that correspond to the rim is generated (S60). For the open rim shot sound, there is: (i) the inside open rim shot sound for the case in which the tip of the stick has struck the center area of the head and the center portion of the stick has struck the rim at the same time; and (ii) the outside open rim shot sound for the case in which the tip of the stick has struck the portion of the drum head near the rim and the center portion of the stick has struck the rim area at the same time. A mixing ratio R/H is set for the outside open rim shot sound and the inside open rim shot sound in conformance with the value of Rc.

The relationship in which the mixing ratio of the closed rim shot sound as well as the outside open rim shot sound and the inside open rim shot sound is in conformance with value of Rc is shown in the graph of 5(*c*). In this graph, the horizontal axis indicates the value of Rc and the vertical axis displays the mixing ratio R/H, which is the ratio of the outside open rim shot sound to the inside open rim shot sound. The specified value that is compared with Rc in the processing of S56 is set to 100. In those cases where the value of Rc is less than 100, the larger the value of Rc, in other words, the larger the vibration of the rim section becomes compared to the vibration of the head section, the closer the mixing ratio R/H gets to 1, and it is set such that the proportion of the outside open rim shot becomes larger.

The sound source 90 is controlled by the setting of the mixing ratio in such a manner. In addition, Rv, which is the velocity that corresponds to R1, is set (S64) and the processing returns from this routine.

FIG. 7(*b*) is a flowchart which substitutes the processing of S70 for the processing of S56 in FIG. 7(*a*). In those cases where, in the flowchart of FIG. 7(*a*), in the determination processing of S50, the value of H1 is smaller than the value of R1 that has been multiplied by k (S50: yes), a determination is made as to whether the leading edge of the waveform of the vibration of the head sensor 21 is positive or not (S70).

FIG. 8 shows the cases in which the waveform of the vibration that has been output by the head sensor 21 is performed in three types of performance modes. The horizontal axis is the time and the vertical axis is the amplitude of the vibration, the top of the drawing is positive, the bottom is negative and, in all of the drawings, the leading edge portion of the waveform is indicated by an arrow.

FIG. 8(*a*) is the case in which only the head is struck by the stick and the leading edge portion of the waveform is directed downward (negative). FIG. 8(*b*) is the waveform in the case of an open rim shot and, the same as in (a) described above, the leading edge of the waveform is directed downward (negative). FIG. 8(*c*) is the case where a closed rim shot is performed and the leading edge of the waveform is directed upward (positive). Thus, the polarity of the case in which only the head is struck (FIG. 8(*a*)) and the polarity of the case where an open rim shot is performed (FIG. 8(*b*)) are the same; and the polarity of the case in which only the head is struck (FIG. 8(*a*)) and the polarity of the case where a closed rim shot is performed (FIG. 8(*c*)) are different.

In the drawings, the amplitudes and point at which the waveform crosses zero are different. However, since these change with the strength of the striking and the location of the striking, the fact that there is a difference for the open rim shot and for the closed rim shot is confirmed by the fact that polarities of the leading edge portions of the waveforms are different.

In those cases where, in the determination processing of S70, the polarity of the leading edge of the waveform of the head sensor 21 is positive (S70: yes), the control is done so as to generate a closed rim shot sound (S58). In those cases where the polarity of the leading edge of the waveform of the head sensor is negative (S70: no), the control is done so as to generate an open rim shot sound (S60). In those cases where the open rim shot sound is generated, the mixing ratio R/H of the outside open rim shot sound and the inside open rim shot sound may be changed in conformance with the value of Rc. For example, in the graph shown in FIG. 5(*c*), the mixing ratio R/H is changed in conformance with the value of Rc for values of Rc less than 100. The outside open rim shot sound and inside open rim shot sound are mixed according to the mixing ratio and the velocity is set to Rv. In those cases where the value of Rc is 100 or greater, the mixing ratio R/H is made 1.

As has been explained above based on an embodiment, it is possible, as one method, to differentiate whether an open rim shot has been performed or a closed rim shot has been performed by analyzing the ratio between the size of the vibration of the head and the size of the vibration of the rim.

As another method, in those cases where the performance is done using a rim shot, it is possible to differentiate whether the performance has been done using an open rim shot or the performance has been done using a closed rim shot by the detection of the polarity of the leading edge of the waveform of the vibration of the head, and the musical tone can be generated by a combination of these performance methods.

In addition, in those cases where the performance has been done using an open rim shot, since the mixing ratio of the outside open rim shot sound and the inside open rim shot sound is further controlled in conformance with the ratio of the size of the vibration of the head and the size of the vibration of the rim, it is possible to form a variety of musical tones in conformance with the performance method and the location of the striking point.

An example of an operation of a comparison means is shown by the processing of S50 of the flowchart that is shown in FIG. 7(*a*). An example of an operation of a musical tone generation control means is shown by the processing of the flowchart that is shown in FIG. 7(*a*). In addition, an example of an operation of a leading edge polarity detection means is shown by the processing of S70 of the flowchart that is shown in FIG. 7(*b*). Another example of an operation of a musical tone generation control means is shown by S56 of the flowchart that is shown in FIG. 7(*a*) substituted in the flowchart that is shown in FIG. 7(*b*).

An explanation was given above of the present invention based on embodiments. However, the present invention is in no way limited to the embodiments described above and the fact that various modifications and changes are possible that do not deviate from and are within the scope of the essentials of the present invention can be easily surmised.

For example, in the above embodiments, the size of the vibration of the head sensor 21 and the value of the size of the vibration of the rim shot sensor 31 multiplied by a specified coefficient k were compared, and a determination was made as to which of the musical tones to generate (a musical tone that corresponds to the head or a musical tone that corresponds to the rim). However, it may also be set up such that the ratio of the size of the vibration of the head sensor 21 and the size of the vibration of the rim shot sensor 31 is derived, and the determination as to which musical tone to generate is made based on the ratio.

In addition, in the above embodiments, it was set up with the head sensor 21 and the rim shot sensor 31 arranged on the sensor frame 4. However, the support member that is cited in Patent Reference 2 may also be used.

In addition, in the embodiments described above, an outside open rim shot sound and an inside open rim shot sound are each stored in the storage means as open rim shot sounds for the sound in those cases where the head and the rim have been struck at the same time. However, it may also be set up such that the sound in which only the center area of the head has been struck, and the sound in the case where only the portion of the head near the rim has been struck, and the sound in which only the rim has been struck are stored separately and these are made into composites by changing the mixing ratios.

In addition, in the case of the generation of a rim shot sound, the velocity is made the size of the vibration that has been detected by the rim shot sensor 31 multiplied by a coefficient (S54 and S64). However, the correction may be carried out by adding the size of the vibration that has been detected by the head sensor 21 and the like.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An electronic percussion instrument, comprising:

input means for inputting a vibration of a head section and a vibration of a rim section that have been detected by a striking detection section;

comparison means for comparing a size of the vibration of the head section and a size of the vibration of the rim section; and musical tone generation control means for controlling a generation of a musical tone based on a result of a comparison by the comparison means such that the musical tone corresponds either to the vibration of the head section or to the vibration of the rim section, and in those cases where the musical tone corresponds to the vibration of the rim section, controlling the generation of the musical tone based on a ratio between the size of the vibration of the rim section and the size of the vibration of the head section such that the musical tone generated is either a first musical tone or a second musical tone.

2. The electronic percussion instrument of claim 1, wherein the musical tone generation control means is one in which in those cases where the first musical tone or the second musical tone is generated in conformance with the vibration of the rim section, a mixing proportion of the two musical tones is controlled based on the ratio between the size of the vibration of the rim section and the size of the vibration of the head section.

3. The electronic percussion instrument of claim 2, wherein the head section is disposed stretched on a top surface of a hollow body section;

wherein the rim section applies tension to the head section;

wherein a support member is linked to an inside of the hollow body section and transmits vibrations of the rim section;

wherein the striking detection section comprises:

a head sensor; and a rim shot sensor;

wherein the head sensor is arranged on the support member with an interposition of a vibration absorbing member and detects the vibration of the head section; and wherein the rim shot sensor detects the vibration of the rim section by detecting a vibration of the support member.

4. The electronic percussion instrument of claim 1, wherein the head section is disposed stretched on a top surface of a hollow body section;

wherein the rim section applies tension to the head section;

wherein a support member is linked to an inside of the hollow body section and transmits vibrations of the rim section;

wherein the striking detection section comprises:

a head sensor; and a rim shot sensor;

wherein the head sensor is arranged on the support member with an interposition of a vibration absorbing member and detects the vibration of the head section; and wherein the rim shot sensor detects the vibration of the rim section by detecting a vibration of the support member.

5. An electronic percussion instrument, comprising:

input means for inputting a vibration of a head section and a vibration of a rim section that have been detected by a striking detection section;

comparison means for comparing a size of the vibration of the head section and a size of the vibration of the rim section;

leading edge polarity detection means for detecting a polarity of a leading edge of the vibration of the head section; and musical tone generation control means for controlling a generation of a musical tone based on a result of a comparison by the comparison means such that the musical tone corresponds either to the vibration of the head section or to the vibration of the rim section, and in those cases where the musical tone corresponds to the vibration of the rim section, controlling the generation of the musical tone such that the musical tone is generated as either a first musical tone or a second musical tone in conformance with the polarity of the leading edge of the vibration of the head section.

6. The electronic percussion instrument of claim 5, wherein the musical tone generation control means is one in which in those cases where the first musical tone or the second musical tone is generated in conformance with the vibration of the rim section, a mixing proportion of the two musical tones is controlled based on a ratio between the size of the vibration of the rim section and the size of the vibration of the head section.

7. The electronic percussion instrument of claim 6, wherein the head section is disposed stretched on a top surface of a hollow body section;

wherein the rim section applies tension to the head section;

wherein a support member is linked to an inside of the hollow body section and transmits vibrations of the rim section;

wherein the striking detection section comprises:

a head sensor; and a rim shot sensor;

wherein the head sensor is arranged on the support member with an interposition of a vibration absorbing member and detects the vibration of the head section; and wherein the rim shot sensor detects the vibration of the rim section by detecting a vibration of the support member.

8. The electronic percussion instrument of claim 5, wherein the head section is disposed stretched on a top surface of a hollow body section;

wherein the rim section applies tension to the head section;

wherein a support member is linked to an inside of the hollow body section and transmits vibrations of the rim section;

wherein the striking detection section comprises:

a head sensor; and a rim shot sensor;

wherein the head sensor is arranged on the support member with an interposition of a vibration absorbing member and detects the vibration of the head section; and wherein the rim shot sensor detects the vibration of the rim section by detecting a vibration of the support member.

9. An electronic percussion instrument, comprising:

a first striking surface;

a second striking surface;

a first sensor for producing a first signal responsive to vibrations of the first striking surface;

a second sensor for producing a second signal responsive to vibrations of the second striking surface; and a controller for determining if a strike is to the second striking surface based on the first and second signals, and in the event that the strike is determined to be to the second striking surface, determining if the strike is also to the first striking surface based on the first signal;

wherein the controller produces a control signal for controlling a sound source to produce a musical tone based on which of the first and second striking surfaces are determined to have received the strike;

wherein, in the event that the controller determines that the strike is to both the first and second striking surfaces, the contoller determines if the strike is to a first region of the first striking surface or to a second region of the first striking surface based on the first and second signals; and wherein, in the event that it is determined by the controller that the strike is to both the first and second striking surfaces, the controller produces the control signal for controlling the sound source to produce the musical tone based on which of the first and second regions of the first striking surface is determined to have received the strike.

10. The electronic percussion instrument of claim 9, wherein the first striking surface comprises a head.

11. The electronic percussion instrument of claim 10, wherein the first sensor comprises a head sensor for producing the first signal responsive to vibrations of the head.

12. The electronic percussion instrument of claim 9, wherein the second striking surface comprises a rim surrounding the first striking surface.

13. The electronic percussion instrument of claim 12, wherein the second sensor comprises a rim shot sensor for producing the second signal responsive to vibrations of the rim.

14. The electronic percussion instrument of claim 9, wherein the controller comprises:

a CPU;

a ROM;and a RAM.

15. The electronic percussion instrument of claim 9, wherein the controller determines if the strike is to the first region of the first striking surface or to the second region of the first striking surface based on a value of a ratio between a maximum value of an amplitude of the second signal and a maximum value of an amplitude of the first signal.

16. The electronic percussion instrument of claim 9, wherein, in the event that the controller determines that the strike is to both the second surface and the first region of the first striking surface, the controller produces the control signal for controlling the sound source to produce the musical tone based on a mixing ratio that varies with a value of a ratio between a maximum value of an amplitude of the second signal and a maximum value of an amplitude of the first signal.

17. The electronic percussion instrument of claim 9, wherein the first striking surface comprises a circular head;

wherein the second striking surface comprises a rim surrounding the head;

wherein the first region of the first striking surface comprises a region of the head that is near a center area of the head; and wherein the second region of the first striking surface comprises a region of the head that is near the rim.

18. An electronic percussion instrument, comprising:

a first striking surface;

a second striking surface;

a first sensor for producing a first signal responsive to vibrations of the first striking surface;

a second sensor for producing a second signal responsive to vibrations of the second striking surface; and a controller for determining if a strike is to the second striking surface based on the first and second signals, and in the event that the strike is determined to be to the second striking surface, determining if the strike is also to the first striking surface base on the first signal;

wherein the controller produces a control signal for controlling a sound source to produce a musical tone based on which of the first and second striking surfaces are determined to have received the strike wherein the controller determines:

(1) if the strike is to the second striking surface by determining whether or not a maximum value of an amplitude of the first signal is less than a maximum value of an amplitude of the second signal multiplied by a predetermined value; or (2) the strike is also to the first striking surface by determining whether or not a polarity of a leading edge portion of a waveform of the first signal is a same polarity as a polarity of a leading edge portion of a waveform of a signal that is produced as the first signal when only the first striking surface is struck.

19. An electronic percussion instrument, comprising:

a first striking surface;

a second striking surface;

a first sensor for producing a first signal responsive to vibrations of the first striking surface;

a second sensor for producing a second signal responsive to vibrations of the second striking surface; and a controller for determining if a strike is to the second striking surface based on the first and second signals, and in the event that the strike is determined to be to the second striking surface, determining if the strike is also to the first striking surface based on the first signal;

wherein the controller produces a control signal for controlling a sound source to produce a musical tone based on which of the first and second striking surfaces are determined to have received the strike;

wherein, in the event that the controller determines that the strike is to the second striking surface;

(1) the controller determines if the strike is also to the first striking surface based on a ratio between the first signal and the second signal; or (2) the controller sets a value H1 to be a maximun value of an amplitude of the first signal when the strike is received; and wherein the controller set a value R1 to be a maximum value of an amplitude of the second signal when the strike is received; and wherein the controller stores a predetermined value G and a predetermined value k; and wherein the controller determines that the strike is to the second striking surface when H1 is less than R1 multiplied by k; and wherein the controller calculates Rc to be G x (R1x k−H1)/R1 and determines if the strike is also to the first striking surface based on a value of Rc.

20. A method for producing a control signal for controlling a sound source to produce a musical tone in response to a strike on an electronic percussion instrument, the electronic percussion instrument having a first striking surface and a second striking surface, the method comprising the steps of:

providing a first signal in response to vibrations of the first striking surface;

providing a second signal in response to vibrations of the second striking surface;

determining, based on the first and second signals, if the second striking surface received the strike, and in the event that it is determined that the second striking surface received the strike, determining, based on the first signal, if the first striking surface also received the strike; and producing the control signal for controlling the sound source to produce the musical tone based on which of the first and second striking surfaces are determined to have received the strike;

determining if the second striking surface received the strike comprises:

(1) determining whether or not a maximum value of an amplitude of the first signal is less than a maximum value of an amplitude of the second signal multiplied by a predetermined value, and in the event that it is determined that the second striking surface received the strike, determining, based on the first signal, if the first striking surface received the strike; or (2) determining based on the first and second signals, and in the event that it is determining that the second striking surface received the strike, determining if the first striking surface also received the strike by determining whether or not a polarity of a leading edge portion of a waveform of tthe first signal is a same polarity as a polarity of a leading edge portion of a waveform of a signal that is provided as the first signal when only the first striking surface is struck; or (3) determining, based on the first and second signals, and in the event that it is determining that the second striking surface received the strike, determining, base on a ratio between the second signal and the first signal, if the first striking surface also received the strike; or (4) determining, based on the first and second signals, and in the event that it is determined that the second striking surface received the strike, determining, based on the first signal, if the first striking surface also received the strike, and in the event that it is determined that the first striking surface also received the strike, determining, based on the first and second signals, if a first region of the striking surface or a second region of the first striking surface received ths strike; and wherein the step of producing the controlling the sound source to produce the musical tone based on which of the first and second striking surfaces are determined to have received the strike, comprises the step of:

producing the control signal for controlling the sound source to produce the musical tone based on which of the first and second striking surfaces are determined to have received the strike, and in the event that both the first and second striking surfaces received the strike, producing the control signal for controlling the sound source to produce the musical tone further based on which of the first and second regions of the first striking surface received the strike.

21. The method of claim 20, wherein the step of determining, based on the first and second signals, if the second striking surface received the strike, and in the event that it is determined that the second striking surface received the strike, determining, based on a ratio between the second signal and the first signal, if the first striking surface also received the strike, comprises the step of:

determining, based on the first and second signals, if the second striking surface received the strike, and in the event that it is determined that the second striking surface received the strike, determining, based on a difference between the second signal and the first signal, if the first striking surface also received the strike.

* * * * *